US006021650A

United States Patent [19]

Okuno et al.

[11] Patent Number: 6,021,650

[45] Date of Patent: Feb. 8, 2000

[54] METHOD OF KNITTING TUBULAR FABRICS

[75] Inventors: Masao Okuno; Takashi Ikegami, both of Wakayama, Japan

[73] Assignee: Shima Seiki Manufacturing, Ltd., Wakayama, Japan

[21] Appl. No.: 09/045,025

[22] Filed: Mar. 20, 1998

[30] Foreign Application Priority Data

Mar. 26, 1997 [JP] Japan ..... 9-072992

[51] Int. Cl.[7] ..... D04B 7/10

[52] U.S. Cl. ..... 66/70; 66/176

[58] Field of Search ..... 66/60 R, 69, 70, 66/73, 175, 176

[56] References Cited

U.S. PATENT DOCUMENTS

| | | | |
|---|---|---|---|
| 3,474,643 | 10/1969 | Robinson et al. | 66/70 |
| 5,701,766 | 12/1997 | Takahashi | 66/70 |
| 5,826,445 | 10/1998 | Okamoto | 66/70 |

FOREIGN PATENT DOCUMENTS

| | | |
|---|---|---|
| 0 821 090 | 7/1997 | European Pat. Off. . |
| 02133637 | 5/1990 | Japan . |
| 2228750 | 9/1990 | United Kingdom . |

*Primary Examiner*—L. Worrell, Jr.
*Attorney, Agent, or Firm*—Nikaido Marmelstein Murray & Oram LLP

[57] ABSTRACT

In a broadening course, a yarn feeder of which front and back agree with the front and back of a fabric is used as a preceding yarn feeder, and a yarn feeder of which front and back are reverse is used as the succeeding yarn feeder, (a) the preceding first yarn feeder is used to knit the first fabric, and to newly feed yarn to needles of the opposing needle bed on the lower side of the knitting direction of the course, and to needles of the original needle bed, and (b) the succeeding yarn feeder is used to knit the first fabric, and to feed yarn again to either one of needles to which yarn was newly fed by the first yarn feeder in the above-mentioned step a.

8 Claims, 7 Drawing Sheets

Prior Art

METHOD OF KNITTING TUBULAR FABRICS

FIELD OF THE INVENTION

The present invention relates to a method of knitting tubular fabrics that uses a flat knitting machine wherein at least a pair of needle beds, one in the front and the other in the back, are provided and at least one of these needle beds can be racked sidewise, and uses a first yarn feeder and a second yarn feeder to make double system knitting, and in particular, the present invention relates to a method of forming a broadened portion in tubular fabrics.

PRIOR ART

When a knitted product such as a pull-over is knitted on a flat knitting machine, a fabric is knitted on each of a front needle bed and a back needle bed, the front and back fabrics are joined at both edges thereof to knit a tubular fabric, and their knitting widths are increased or decreased to change the diameters of the tubular fabric so as to obtain the desired form. With this arrangement, sewing works after the completion of knitting can be reduced. A variety of such knitting methods have been investigated up to the present, and these methods are called seamless knitting methods. As a technique for making seamless knitting, there is a broadening method that increases the knitting width. According to the conventional broadening methods, holes are formed in a broadened portion. A variety of methods of concealing holes in a broadened portion have been investigated up to the present, and the present applicant proposed a broadening method in Japanese Provisional Patent Hei 2-133637.

When a pull-over is knitted, a left sleeve and a right sleeve are arranged with a body between them, and each of these parts is knitted in a tubular form by using a dedicated yarn feeder. A sleeve that is knitted from the lower sleeve edge towards the side is shifted towards the side of the body that is knitted from the waist band towards the neck, and as knitting of the body proceeds, a loop of the sleeve and a loop of the body are overlapped with each other, and a loop of the next course is formed on said overlapped loops to join the body and the sleeve. The sleeve is knitted in such a way that the diameter of the tubular form is increased gradually from the lower sleeve edge to the side. In this step, broadening is made in one edge of the sleeve, the edge being adjacent to the body and being hidden from sight when the pull-over is put on. Broadening is not made in the edge that is opposite to the body and appears on the outer side. This is to avoid marring the appearance of the fabric.

To knit fabrics efficiently, double system knitting is made by using a flat knitting machine that is provided with two yarn feeders, a preceding one and a succeeding one, and at least two knitting systems to use said two yarn feeders to knit. In said double system knitting, two yarn feeders are used as a preceding one and a succeeding one, they are made to travel in the longitudinal direction of the needle beds at different phases, and loops are formed separately by the preceding yarn feeder and by the succeeding yarn feeder. However, when double system knitting is used and yarns are fed circularly to needles of both front and back needle beds to knit a tubular fabric, at one of the edges being the turning points of the travelling direction of each yarn feeder, the yarn of the preceding yarn feeder and the yarn of the succeeding yarn feeder cross with each other, and adjacent loops are pulled by this crossing to generate a hole in the edge of fabrics.

FIG. 8 shows the positional relationship of yarn feeders when double system knitting is made by using a yarn feeder A that is indicated by a white triangle and a yarn feeder B that is indicated by a black triangle. The yarn feeder A is provided on a guide rail (not illustrated) that is on this side (front side) of the knitting machine that is seen from the front. The yarn feeder B is provided on a guide rail (not illustrated) that is on the other side (back side). The leftward and rightward arrows in the diagram show knitting directions. For example, when a front fabric FF is to be knitted, the yarn feeders are shifted to the left to knit, and the yarn feeder B is used as the preceding yarn feeder, and the yarn feeder A is used as the succeeding yarn feeder. Similarly, the rightward arrow indicates that the back fabric BF is knitted rightward by using the yarn feeder B as the preceding yarn feeder and the yarn feeder A as the succeeding yarn feeder. On both sides of the fabrics, the yarn feeders are shown at their respective positions when knitting of one course is completed. In FIG. 8, when the front fabric FF is knitted leftward, both the yarn feeder A and the yarn feeder B are located on the left of the tubular fabric. On the other hand, when the back fabric BF is knitted rightward, the yarn feeders A, B are located on the right of the tubular fabric. When rightward knitting of a course of the back fabric BF is completed, the yarn stretching towards the yarn feeder A passes over the yarn stretching from the fabric to the yarn feeder B. In the next course, when knitting is made by using the yarn feeder B as the preceding yarn feeder, the yarn of the yarn feeder A and the yarn of the yarn feeder B cross with each other. A crossing of yarns is generated at the right edge of the fabric indicated by an asterisk. As shown in FIG. 8, a crossing of yarns is generated when the front-back relationship of the fabric to be knitted agrees with the front-back relationship of the yarn feeder being used as the preceding yarn feeder. For example, when the back fabric is knitted rightward, the yarn feeder B on the back guide rail is used as the preceding yarn feeder. In this case, a crossing of yarns is generated at the right edge of the fabric.

SUMMARY OF THE INVENTION

In view of the above-mentioned problems, one objective of the present invention is to make holes generated in broadened portions inconspicuous when double system knitting is used to knit a first tubular knitted fabric and a second tubular knitted fabric on different areas of the needle beds, and at the same time, to make holes generated in one edge inconspicuous when double system knitting is made.

To achieve the above-mentioned objective, the method of knitting tubular fabrics of the present invention is a method of knitting tubular fabrics wherein is used a flat knitting machine, which is provided with at least a pair of needle beds, one in the front and one in the back, at least one of the needle beds being able to be racked sidewise, is provided with a first yarn feeder and a second yarn feeder, being able to be reciprocated on different guide rails one in the front and one in the back, and is provided with at least two knitting systems, the first and second yarn feeders are used as a preceding yarn feeder and a succeeding yarn feeder, double system knitting is used to knit a first tubular fabric comprising a first fabric and a second fabric being joined at both edges thereof, and to knit a second tubular fabric comprising a first fabric and a second fabric being joined at both edges thereof by using needles of a knitting area differing from that of the first tubular knitted fabric, the edge of the first tubular fabric on the side of the second tubular fabric is broadened to have desired diameters of the tubular fabric, then the first tubular fabric and the second tubular fabric are joined together, the method of knitting tubular fabrics being characterized in that in knitting a course for forming a broadened portion on the edge on the lower end of the knitting direction of the first tubular fabric, a yarn feeder of which front and back agrees with the front and back of the fabric to be knitted is used as the preceding yarn feeder, and the step of forming a broadened portion in the first tubular fabric includes the following steps:

(a) a step wherein the preceding first yarn feeder is used to knit the first fabric, and yarn is newly fed to a needle of the opposing needle bed being located on the lower side of the knitting direction of the course and to needles of the original needle bed in the knitting direction; and (b) a step wherein the succeeding second yarn feeder is used to knit the first fabric, and yarn is fed again to either of the groups of needles to which yarn was newly fed by the first yarn feeder in step a.

The method of knitting tubular fabrics according to the present invention is characterized to include, in succession to the above-mentioned knitting steps, the following steps:

(c) a step wherein the first and second yarn feeders are reversed, and the preceding second yarn feeder is used to knit the first fabric;

(d) a step wherein the succeeding first yarn feeder is used to knit the first fabric;

(e) a step wherein after the first and second yarn feeder are reversed, the preceding second yarn feeder is used to knit the second fabric, and yarn is fed to needles of said original needle bed to which yarn was newly fed, and in succession, yarn is fed to needles of the opposing needle bed adjacent on the lower end in the knitting direction of said needles, (f) a step wherein the succeeding first yarn feeder is used to knit the second fabric, and tacking is made to one needle of the original needle bed to which yarn was fed in step e;

(g) a step wherein the preceding first yarn feeder is used to knit the second fabric in the direction opposite to that of step e; and (h) a step wherein the succeeding second yarn feeder is used to knit the second fabric in the direction opposite to that in step f.

The method of knitting tubular fabrics according to the present invention is characterized to include, in succession to the above-mentioned knitting steps, the following steps:

(c) a step wherein the first and second yarn feeders are reversed, and the preceding first yarn feeder is used to knit the second fabric;

(d) a step wherein the succeeding second yarn feeder is used to knit the second fabric;

(e) a step wherein the first and second yarn feeder are reversed, the preceding first yarn feeder is used to knit the first fabric;

(f) a step wherein the second yarn feeder is used to knit the first fabric;

(g) a step wherein the first and second yarn feeders are reversed again, and the preceding first yarn feeder is used to feed yarn to needles of the original needle bed to which yarn was fed in said step a to knit, and the second fabric is knitted; and (h) a step wherein the succeeding second yarn feeder is used to tack to one needle of the original needle bed on which knitting was made in step g, and the second fabric is knitted.

The method of knitting tubular fabrics of the present invention is a method of knitting tubular fabrics wherein is used a flat knitting machine, which is provided with at least a pair of needle beds, one in the front and one in the back, at least one of the needle beds being able to be racked sidewise, is provided with a first yarn feeder and a second yarn feeder, being able to be reciprocated on different guide rails one in the front and one in the back, and is provided with at least two knitting systems, the first and second yarn feeders are used as a preceding yarn feeder and a succeeding yarn feeder, double system knitting is used to knit a first tubular fabric comprising a first fabric and a second fabric being joined at both edges thereof, and to knit a second tubular fabric comprising a first fabric and a second fabric being joined at both edges thereof by using needles of a knitting area differing from that of the first tubular knitted fabric, the edge of the first tubular fabric on the side of the second tubular fabric is broadened to have desired diameters of the tubular fabric, then the first tubular fabric and the second tubular fabric are joined together, the method of knitting tubular fabrics being characterized in that in knitting a course for forming a broadened portion on the edge on the lower end of the knitting direction of the first tubular fabric, a yarn feeder of which front and back agree with the front and back of the fabric to be knitted is used as the preceding yarn feeder, and the step of forming a broadened portion in the first tubular fabric includes the following steps:

(a) a step wherein the preceding first yarn feeder is used to feed yarn to needles holding loops of the first fabric except a loop at the edge on the lower side of the knitting direction of the first fabric to knit, and yarn is newly fed to the needle on the lower side of the knitting direction of the needle bed opposing to the needle holding the loop of the edge of the first fabric;

(b) a step wherein the succeeding second yarn feeder is used to knit the first fabric;

(c) a step wherein the first and second yarn feeders are reversed, and the preceding first yarn feeder is used to knit the second fabric; and (d) the succeeding second yarn feeder is used to feed yarn to needles on the upper side of the knitting direction of the needle bed opposing to needle to which yarn was newly fed in the step a, and the second fabric is knitted.

According to the configuration of the present invention, the first tubular fabric and the second tubular fabric are knitted by using different areas on the needle beds, and when the edge on the second tubular fabric side of the first tubular fabric is broadened, in a course to be knitted towards the edge of the first tubular fabric to be broadened on the side of the second tubular fabric, the yarn feeder that agrees with the front and back of the fabric to be knitted is used as the preceding yarn feeder and broadening is made, after that, the first tubular fabric is shifted towards the second tubular fabric, and loops of the first tubular fabric on the side of the second tubular fabric are overlapped with loops of the second tubular fabric sequentially to connect the first tubular fabric and the second tubular fabric together. As a result, broadening of the first tubular fabric and crossing of yarns are generated on the same edge, and the crossing of yarns and holes generated in the broadened portion become inconspicuous. Moreover, the edge with the broadened portion and the crossing of yarns is concealed by the second tubular fabric and becomes inconspicuous.

The method of knitting tubular fabrics according to the present invention is also characterized in that hole filling knitting is made wherein prior to formation of a broadening portion, yarn is fed to needles holding two stitches on the outer side of one needle bed, said needle bed holding loops located on the most outer side of the loops being held on needles of both front and back needle beds at the edge to be broadened, and to a needle at the edge of the opposing needle bed alternately in the travelling direction of the yarn feeder, and in the next course, yarn is fed to needles on said opposing needle bed except said needle located at the edge.

In this way, at a broadening portion, loops of the front and back fabrics are pulled by each other to prevent formation of any opening between loops, and to make less conspicuous holes generated in the broadening portion.

The method of knitting tubular fabrics of the present invention is a method of knitting tubular fabrics wherein is used a flat knitting machine, which is provided with at least a pair of needle beds, one in the front and one in the back, at least one of the needle beds being able to be racked sidewise, is provided with a first yarn feeder and a second yarn feeder, being able to be reciprocated on different guide rails one in the front and one in the back, and is provided with at least two knitting systems, said first and second yarn feeders are used as a preceding yarn feeder and a succeeding yarn feeder, double system knitting is used to knit a first tubular fabric comprising a first fabric and a second fabric being joined at both edges thereof, and to knit a second tubular fabric comprising a first fabric and a second fabric being joined at both edges thereof by using needles of a knitting area differing from that of the first tubular knitted fabric, the edge of the first tubular fabric on the side of the second tubular fabric is broadened to have desired diameters of the tubular fabric, then the first tubular fabric and the second tubular fabric are joined together, the method of knitting tubular fabrics being characterized in that in knitting a course for forming a broadened portion on the edge on the lower end of the knitting direction of the first tubular fabric, a yarn feeder of which front and back agree with the front and back of the fabric to be knitted is used as the preceding yarn feeder, and the step of forming a broadened portion in the first tubular fabric includes the following steps:

(a) a step of racking the first needle bed or the second needle bed so that the needle holding the loop at the edge of the first fabric on the first needle bed is positioned closer to the broadening formation side than the needle holding the loop of the edge of the second fabric on the second needle bed;

(b) a step wherein the preceding first yarn feeder is used to feed yarn to needles holding loops of the first fabric except a needle holding the loop at the edge on the lower side of knitting direction of the first fabric, and yarn is newly fed to needles of the second needle bed located on the lower side of the knitting direction;

(c) a step wherein the succeeding second yarn feeder is used to newly feed yarn to needles holding the loops of the first fabric and to needles of the second needle bed located on the lower side of the knitting direction;

(d) a step wherein the first and second yarn feeders are reversed, and the preceding first yarn feeder is used to feed yarn to needles holding the second fabric except a needle holding the loop at the edge on the upper side of the knitting direction of the second fabric to knit;

(e) a step wherein the succeeding second yarn feeder is used to feed yarn to the needles of the second needle bed to which yarn was newly fed in step b and step c, and to the needles holding the loops of the second fabric to knit; and (f) a step wherein in succession to the yarn newly fed to the needles of the second needle bed in said step c, loops formed in said step e are transferred to needles of the opposing needle bed.

According to the configuration of the present invention, a broadening portion of the first tubular fabric is made on its edge on the side of the second tubular fabric, and in knitting a course towards this edge, a yarn feeder that agrees with the front and back of the fabric to be knitted is used as the preceding yarn feeder to form the broadening portion. After that, the first tubular fabric is shifted towards the second tubular fabric, and loops of the first tubular fabric on the side of the second tubular fabric are overlapped with loops of the second tubular fabric sequentially to connect the first tubular fabric and the second tubular fabric together. As a result, broadening of the first tubular fabric and crossing of yarns are generated on the same edge, and holes generated by the crossing of yarns and broadening become inconspicuous. Moreover, the broadened portion and crossing of yarns are concealed by the second tubular fabric and becomes inconspicuous. When the broadening portion is formed, the first needle bed or the second needle bed is racked so that the needle holding the loop at the edge of the first fabric is closer to the broadening portion formation side than the needle holding the loop at the edge of the second fabric.

The method of knitting tubular fabrics of the present invention is a method of knitting tubular fabrics wherein is used a flat knitting machine, which is provided with at least a pair of needle beds, one in the front and one in the back, at least one of the needle beds being able to be racked sidewise, is provided with a first yarn feeder and a second yarn feeder, being able to be reciprocated on different guide rails one in the front and one in the back, and is provided with at least two knitting systems, the first and second yarn feeders are used as a preceding yarn feeder and a succeeding yarn feeder, and double system knitting is used to knit tubular fabrics, each comprising a first fabric and a second fabric being joined at both edges thereof, the method of knitting tubular fabrics being characterized in that in knitting to an edge where crossing of the yarn of the preceding yarn feeder and the succeeding yarn feeder is generated, yarn feeding to any one needle of the needles holding a pair of stitches one in the front and one in the back located at the edge where crossing of yarns is generated is made either the first yarn feeder or the second yarn feeder.

With the above-mentioned configuration of the invention, at the portion where yarns cross with each other, the number of courses of the fabric is reduced to one half of other wales, and as the loops are stretched, holes generated by crossing of the yarn of the preceding yarn feeder and that of the succeeding yarn feeder are concealed, thus making crossing of yarns inconspicuous.

As described above, in the method of knitting tubular fabrics according to the present invention, the first tubular fabric and the second tubular fabric are knitted by using different areas of needle beds, and when a broadening portion is formed on the edge of the first tubular fabric on the side of the second tubular fabric, in knitting a course towards the edge on which the broadening portion of the first tubular fabric is to be formed on the side of the second tubular fabric, a yarn feeder that agrees with the front and back of the fabric to be knitted is used as the preceding yarn feeder to form the broadening portion to get the desired diameters of the tubular fabric, then the first tubular fabric is shifted towards the second tubular fabric, and loops of the first tubular fabric on the side of the second tubular fabric are overlapped with loops of the second tubular fabric sequentially to connect the first tubular fabric and the second tubular fabric together. By this arrangement, the edge of the first tubular fabric on which the broadening portion is formed is the same edge on which crossing of yarns is generated. Thus holes generated in portions where broadening is made and yarns are crossed become inconspicuous. Moreover, the edge on which the broadening portion is formed and yarns are crossed is concealed by the second tubular fabric, and is inconspicuous.

When hole filling knitting is made prior to formation of a broadening portion, as loops of the front and back fabrics are pulled by each other at the broadening portion, spaces between loops are prevented from opening, and holes generated in the broadening portion become less conspicuous.

When knitting is made to the edge where crossing of the yarn of the preceding yarn feeder and the yarn of the succeeding yarn feeder are crossed with each other, if yarn feeding to any one needle of the pair of needles one in the front and one in the back located at the edge where crossing of yarns is generated is made by either the first yarn feeder or the second yarn feeder, the number of courses of the fabric on the yarn crossing portion is reduced to one half of other wales. As the loops are stretched, holes generated by crossing of the yarn of the preceding yarn feeder and the yarn of the succeeding yarn feeder are concealed, making crossing of yarns less conspicuous.

DESCRIPTION OF THE PREFERRED EMBODIMENTS

Figure 1A:
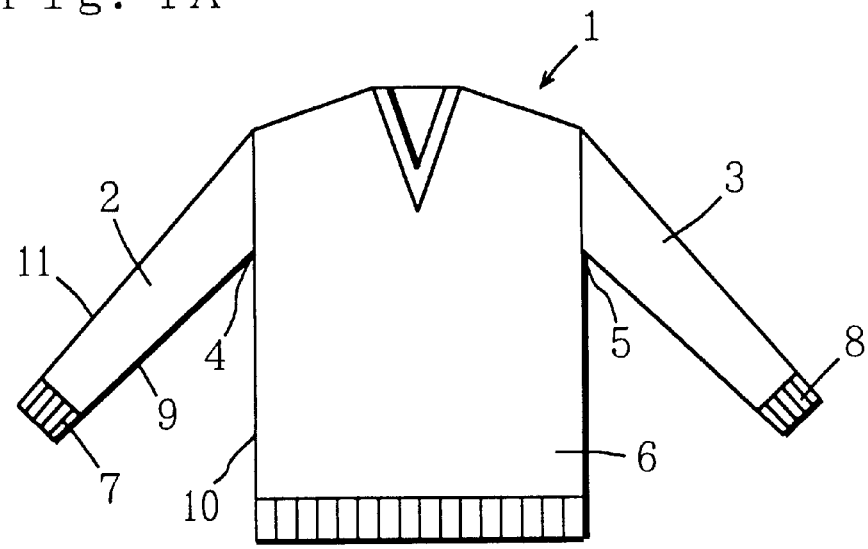
FIG. 1A is a diagram showing a pull-over to be knitted by the present invention.
Figure 1B:
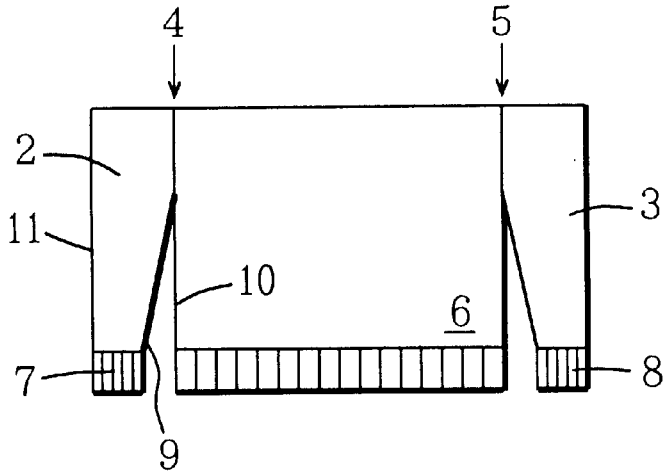
FIG. 1B is a diagram showing the pull-over when knitting is completed up to the upper edge of the side.
Figure 1C:
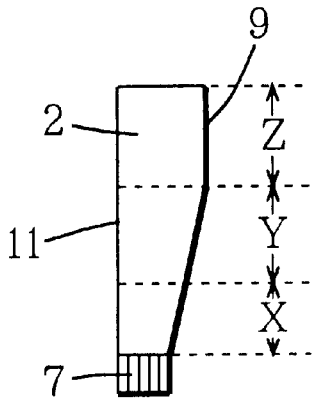
FIG. 1C is a diagram showing the right sleeve of the pull-over of FIG. 1A.

In the following, the methods of knitting tubular fabrics according to the embodiments will be described in detail with reference to the drawings. FIG. 1A shows the state of completion of a pull-over 1 that is to be knitted by the method of knitting tubular fabrics according to the present invention. FIG. 1B shows the state of the pullover 1 of FIG. 1A when it is knitted up to the top edges of both sides 4, 5 at which joining of both the left and right sleeves 2, 3 and the body is started. FIG. 1C shows the right sleeve 2 of the pull-over 1. In the pull-over 1, a body 6 that is to be knitted in a tubular form, and tubular left and right sleeves 2, 3 that are to be knitted by using areas left to and right to the body, with the body 6 between, are formed. In the left and right sleeves 2, 3, broadening portions are formed at edges adjacent to the body. Each of the left and right sleeves 2, 3 comprises a lower edge rib stitch part 7 or 8 being the starting point of knitting, a part X where both the front fabric FF and the back fabric BF are broadened by one stitch for every two courses, a part Y where both fabrics are broadened by one stitch for every four courses, and a part Z where both fabrics are broadened by one stitch for every six courses.

The body 6 and the left and right sleeves 2, 3 are knitted in parallel by double system knitting using two yarn feeders that can be shifted sidewise on different guide rails one in the front (this side) and one in the back (the other side) seen from the front of the flat knitting machine. The left and right sleeves 2, 3 are shifted towards the body when knitting from the lower edge parts 7, 8 to the top of sides 4, 5 is completed, and the loops on the body side are overlapped with the loops of the body 6 sequentially to join the sleeves and the body 6 together. In the following, embodiments of the method of knitting tubular fabrics will be explained with reference to the knitting course diagrams FIG. 2 through FIG. 6. With regard to knitting of the left and right sleeves 2, 3, the knitting method is the same except the left and right relationship is reversed. Hence knitting of only the right sleeve 2 will be explained in the following.

To simplify the explanation, the numbers of needles used are reduced significantly from those used in actual knitting. Numbers at the left end of the diagram indicate the course numbers. 1st on the right of these numbers indicates knitting with the preceding yarn feeder. 2nd indicates knitting with the succeeding yarn feeder. F indicates the front bed, and B indicates the back bed. In these diagrams, yarn feeders used for knitting the right sleeve 2 and the body 6 in each course are indicated, and the knitting direction is marked by an arrow. With regard to the yarn feeders used for knitting the right sleeve 2 and the body 6, the yarn feeder used for preceding knitting is shown below the broken line, and the yarn feeder used for succeeding knitting is shown above the broken line. The yarn feeder A is closer to the front side of the flat knitting machine than the yarn feeder B. Similarly, the yarn feeder C is closer to the front side of the flat knitting machine than the yarn feeder D.

The broadening method of this embodiment is made on a flat knitting machine which is provided with at least a pair of needle beds, one in the front and one in the back, at least one of said needle beds being able to be racked sidewise, is provided with at least two yarn feeders, being able to be reciprocated in the longitudinal direction of the needle beds, and is provided with at least two knitting systems for knitting with the preceding and succeeding yarn feeders. In case of a flat knitting machine with two needle beds, the needles of odd numbers may be used as needles for knitting front fabrics, and the needles of even numbers may be used as needles for knitting back fabrics. As a result, needles for transferring are arranged between needles used for loop formation. With this arrangement, fabrics including back stitch structure can be knitted in a tubular form. When a flat knitting machine is used with four needle beds where above each of a pair of needle beds, one in the front and one in the back, an upper auxiliary needle bed having means of transferring is provided, with the use of the transferring means of the upper auxiliary needle beds, full needles of the lower needle beds can be used for knitting. For the convenience of explanation, in the following embodiments, a case of knitting a front fabric FF and a back fabric BF with plain stitch is used as an example, and explanation is limited to the knitting of a broadening portion.

Figure 2:
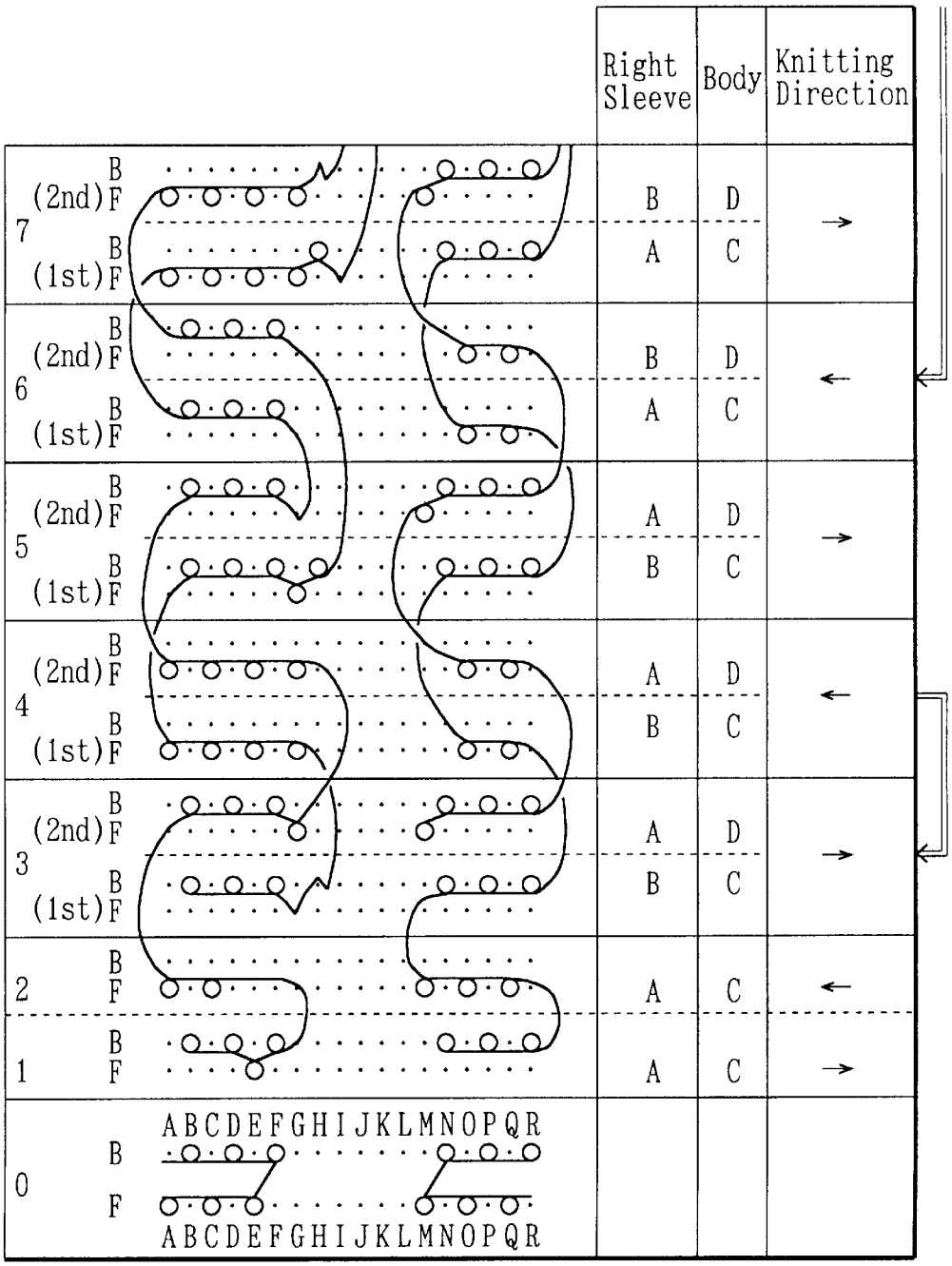
FIG. 2 shows a knitting course of the embodiment 1 of the present invention.
Figure 3:
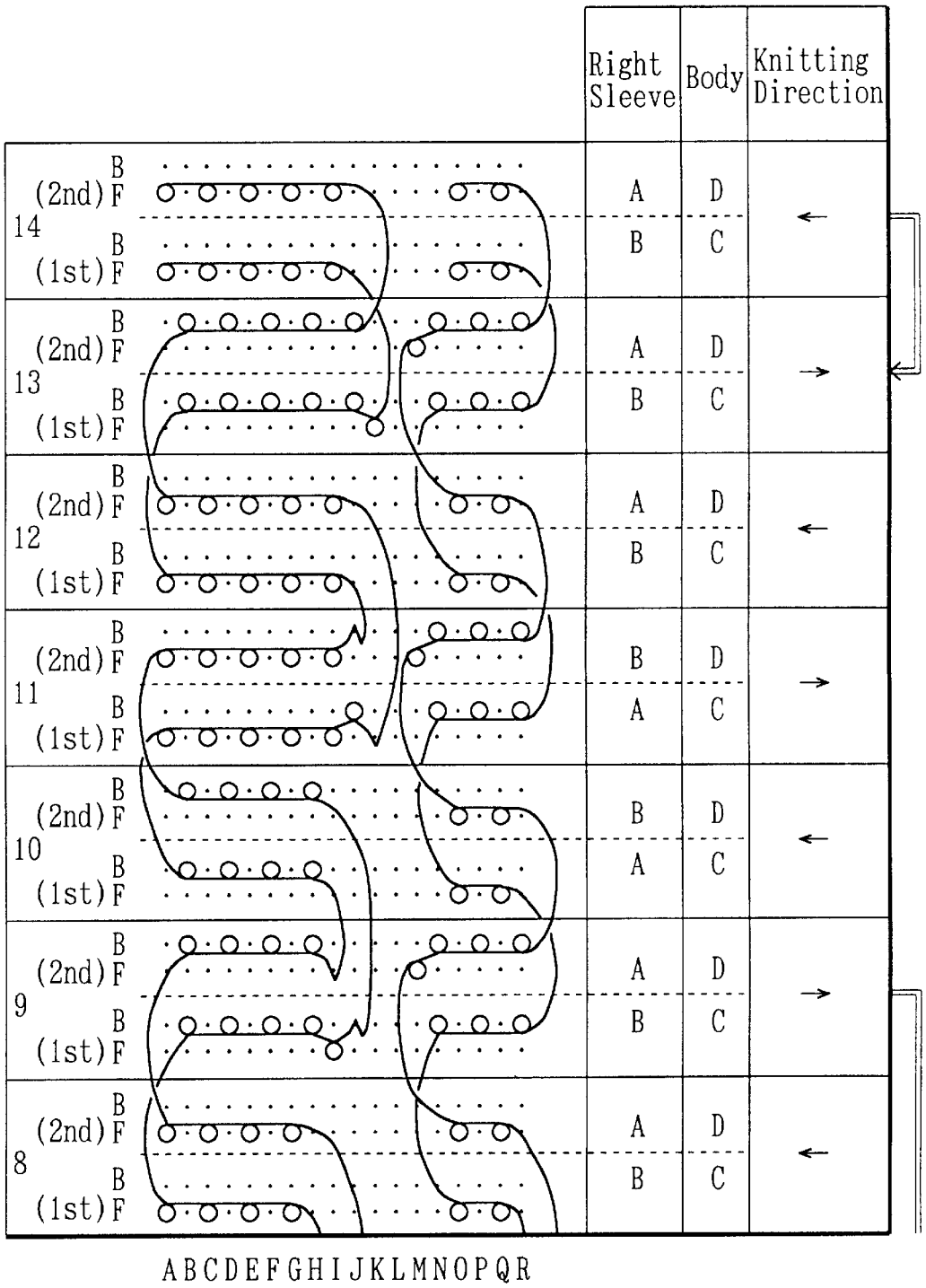
FIG. 3 shows a knitting course of the embodiment 1 of the present invention.

The first embodiment will be explained with reference to FIG. 2 and FIG. 3. The course 0 of FIG. 2 shows the state before starting the formation of a broadened portion. Loops held on every other needles A•C•E of the front bed are those of the front fabric FF of the right sleeve 2, and loops held on the needles B•D•F of the back bed are those of the back fabric BF of the right sleeve 2. Loops held on needles M•O•Q of the front bed are those of the front fabric FF of the body 6, and the loops held on needles N•P•R of the back bed are those of the back fabric BF of the body 6. Explanation and illustration of knitting that takes place to the left of the needles A of the front and back beds and knitting that takes place to the right of the needles R of the front and back beds are omitted.

In the course 1, the yarn feeder A is used to feed yarn to the needles B•D of the back bed, the needle E of the front bed and the needle F of the back bed sequentially to knit the right sleeve 2. In parallel with this, the yarn feeder C is used to feed yarn to the needles N•P•R of the back bed to knit the body 6. In the course 2, the yarn feeder A is used to feed yarn to the needles C•A of the front bed, and the yarn feeder C is used to feed yarn to the needles Q•O•M of the front bed. Knitting given to the right sleeve 2 in the course 1 and the course 2 is hole filling knitting that make holes generated in the broadening start portion inconspicuous. This hole filling knitting, that is made before starting broadening, prevents spaces between loops of the front fabric FF and loops of the back fabric BF from being spread. However, this hole filling knitting is not necessarily needed. It may be used when closure of holes is not adequate, due to, for example, the material of yarn, and size of the loop to be formed.

In the course 3 in which knitting for forming a broadened portion is started, when the back fabric BF of the right sleeve 2 is knitted towards the right edge 9 in which a broadened portion is formed, the yarn feeder B that is closer to the back side of the knitting machine than the yarn feeder A is used as the preceding yarn feeder to feed yarn to every other needles B•D•F of the back bed holding the loops of the back fabric BF, the needle G of the front bed, and the needle H of the back bed. The succeeding yarn feeder A is used to feed yarn to every other needles B•D•F of the back bed to knit the back fabric BF, and to feed yarn to the needle G of the front bed to form a new loop on the needle G of the front bed holding the yarn constituting the front fabric FF. In parallel with this, for the body 6, the preceding yarn feeder C is used to feed yarn to needles N•P•R of the back bed to knit, and the succeeding yarn feeder D is used to feed yarn to the needle M of the front bed and needles N•P•R of the back bed to knit the body 6. When the above-mentioned course 3 is completed, the yarn of the yarn feeder A and the yarn of the yarn feeder B cross with each other on the body side of the right sleeve. On the other hand, the yarn of the yarn feeder C and the yarn of the yarn feeder D do not cross on the left sleeve side of the body. In the course 4, for the right sleeve 2, the preceding yarn feeder B is used to feed yarn to every other needles G•E•C•A of the front bed, and the succeeding yarn feeder A is used to feed yarn to needles G•E•C•A of the front bed to knit. In parallel with this, for the body 6, the preceding yarn feeder C is used to feed yarn to needles Q•O of the front bed, and the succeeding yarn feeder D is used to feed yarn to needles Q•O of the front bed to knit.

When the knitting given to the right sleeve 2 in the course 3 and the course 4 above is repeated on empty needles in the direction of increasing the knitting width, broadening by one stitch is effected for every two courses of the front fabric FF and the back fabric BF of the right sleeve 2. As a result, the part X of the sleeve fabric 2 shown in FIG. 1C is formed.

For the body 6, when the front fabric FF is knitted, the yarn feeder on the front side is used as the preceding yarn feeder; crossing of the yarns is generated only on the left edge 10 of the body 6. To make crossing of yarns inconspicuous, in the course 3 and course 4, the loop of the needle M, being the loop at the left edge of the front fabric FF, is formed in a course for knitting the back fabric BF. With this arrangement, the loop to be formed on the needle M of the front bed is formed as a loop twisted by one half turn, and the number of courses of the fabric formed on the needle M is reduced to one half of other wales. Hence the loop formed on the needle M is extended, and this loop can hide the hole that is generated by crossing of the yarn of the preceding yarn feeder and the yarn of the succeeding yarn feeder. As the knitting of the course 3 and the course 4 is made on the entire knitting of the body, double system knitting, that controls the generation of hole in the edge due to crossing of yarns, can be made. This knitting is also made in knitting of the part Z of the left sleeve that will be explained later. As the subsequent knitting of the body 6 is the repetition of the knitting indicated in the course 3 and the course 4, in the following explanation, the explanation of knitting of the body 6 is omitted.

Next, knitting of the part Y will be explained, where the front fabric FF and the back fabric BF are broadened by one stitch each while four courses of each of the front fabric FF and the back fabric BF are knitted. In the course 5, for the right sleeve 2, the preceding yarn feeder B is used to feed yarn to needles B•D•F of the back bed and the needle G of the front bed and the needle H of the back bed to knit, and the succeeding yarn feeder A is used to feed yarn to needles B•D•F of the back bed to knit, and to the needle G of the front bed to tack, and knit the right sleeve 2. In this step, as the yarn fed in the course 3 is held on the needle G of the front bed and the needle H of the back bed to which yarn is to be fed by the preceding yarn feeder B, normal loops are formed. Next, in the course 6, the yarn feeder A, which was used as the succeeding yarn feeder in the course 5, is used as the preceding yarn feeder to feed yarn to needles F•D•B of the back bed, and the succeeding yarn feeder B is used to feed yarn to the same needles F•D•B to knit.

As shown above, in the course 5 and beyond, C-knitting is given to the front fabric FF and the back fabric BF, where the direction of travelling of the yarn feeder is reversed at the right edge 9 of the right sleeve 2, that is the portion to be broadened, and two courses of the same fabric are knitted. Here, as the yarn feeders are switched over in the course 6, the yarn feeder A is used as the preceding yarn feeder and the yarn feeder B is used as the succeeding yarn feeder, there is no crossing of yarns at the left edge 11 of the right sleeve 2. In the course 7, the preceding yarn feeder A is used to feed yarn to needles A•C•E•G of the front bed and the needle H of the back bed and the needle I of the front bed, and the succeeding yarn feeder B is used to feed yarn to needles A•C•E•G of the front bed and the needle H of the back bed. Next, in the course 8 of FIG. 3, the preceding yarn feeder B is used to feed yarn to needles G•E•C•A of the front bed to knit, and the succeeding yarn feeder A is used to the same needles G•E•C•A of the front bed to knit. In the course 9, the preceding yarn feeder B is used to feed yarn to needles B•D•F•H of the back bed and the needle I of the front bed to knit, and to feed yarn to the needle J of the back bed, and the succeeding yarn feeder A is used to feed yarn to needles B•D•F•H of the back bed to knit, and to feed yarn to the needle I of the front bed. When the knitting shown in the course 6 through the course 9 is repeated in the direction of widening the knitting width, the part Y is formed, where the front fabric and the back fabric are broadened by one stitch each for every four courses formed on the front fabric and the back fabric, respectively.

Next, knitting of the part Z will be explained, where the front fabric FF and the back fabric BF are broadened by one stitch each while six courses of each of the front fabric FF and the back fabric BF are knitted. In the course 9 through the course 12, knitting is similar to that of the course 5 through the course 8. In the course 13, to knit the back fabric BF, the preceding yarn feeder B is used to feed yarn to needles B•D•F•H•J of the back bed and the needle K of the front bed to knit, and the succeeding yarn feeder A is used to feed yarn to needles B•D•F•H•J of the back bed to knit. In the course 14, the preceding yarn feeder B is used to feed yarn to needles I•G•E•C•A of the front bed, and the succeeding yarn feeder A is used to feed yarn to the same needles I•G•E•C•A of the front bed to knit. When broadening is made for every six courses or more, this broadening can be made at any desired ratio by adding an appropriate number of repetition of the knitting shown in the course 13 and the course 14 to the knitting shown in the course 6 through the course 9. The knitting in the courses 13, 14 is similar to that given to the body 6 in the courses 3, 4 of FIG. 2 described above. In the courses 13, 14, broadening is not made, and this knitting is intended to make inconspicuous a hole generated by crossing of the yarn of the yarn feeder A and that of the yarn feeder B. As explained above, in the first embodiment, course for broadening are knitted by backtrack knitting. Courses not to be broadened, such as those used in broadening for every six courses, are knitted by circularly feeding yarn to the front and back fabrics.

In the right sleeve 2 knitted by the above-mentioned knitting procedure, the preceding yarn B is used, in the course 5, to feed yarn to needles of the back bed holding loops of the back fabric BF, and to form a loop on the needle G of the front bed, and the succeeding yarn feeder A is used to feed yarn to needles of the back bed, and to tack on the needle G of the front bed. In this way, for example, when the front fabric FF is knitted, at an edge thereof, yarn is fed to a needle holding a loop of the back fabric BF. On the other hand, as shown in the course 7, when the back fabric is knitted, yarn is fed to a needle holding a loop of the front fabric FF, and backtrack knitting is made. As a result, at the edge, the yarn constituting the front fabric FF and the yarn constituting the back fabric BF are entangled with each other to join the front fabric FF and the back fabric BF at the right edge 9.

The hole filling knitting explained in the embodiment 1, and the tubular knitting when broadening is made for knitting of every six courses or more of the front and back fabrics are applicable to the following examples. However, to keep the explanation simple, explanation of the hole filling knitting and the tubular knitting will be omitted in the following embodiments. The right sleeve 2 is broadened to a desired diameter of the tubular form by the above-mentioned knitting for broadening. Then the loops of the right sleeve 2 at the right edge are overlapped with loops of the body 6 sequentially to join the right sleeve with the body 6. As the method for joining the right sleeve and the body 6 is disclosed in Japanese Provisional Patent Hei 2-229248, its explanation is omitted here.

Figure 4:
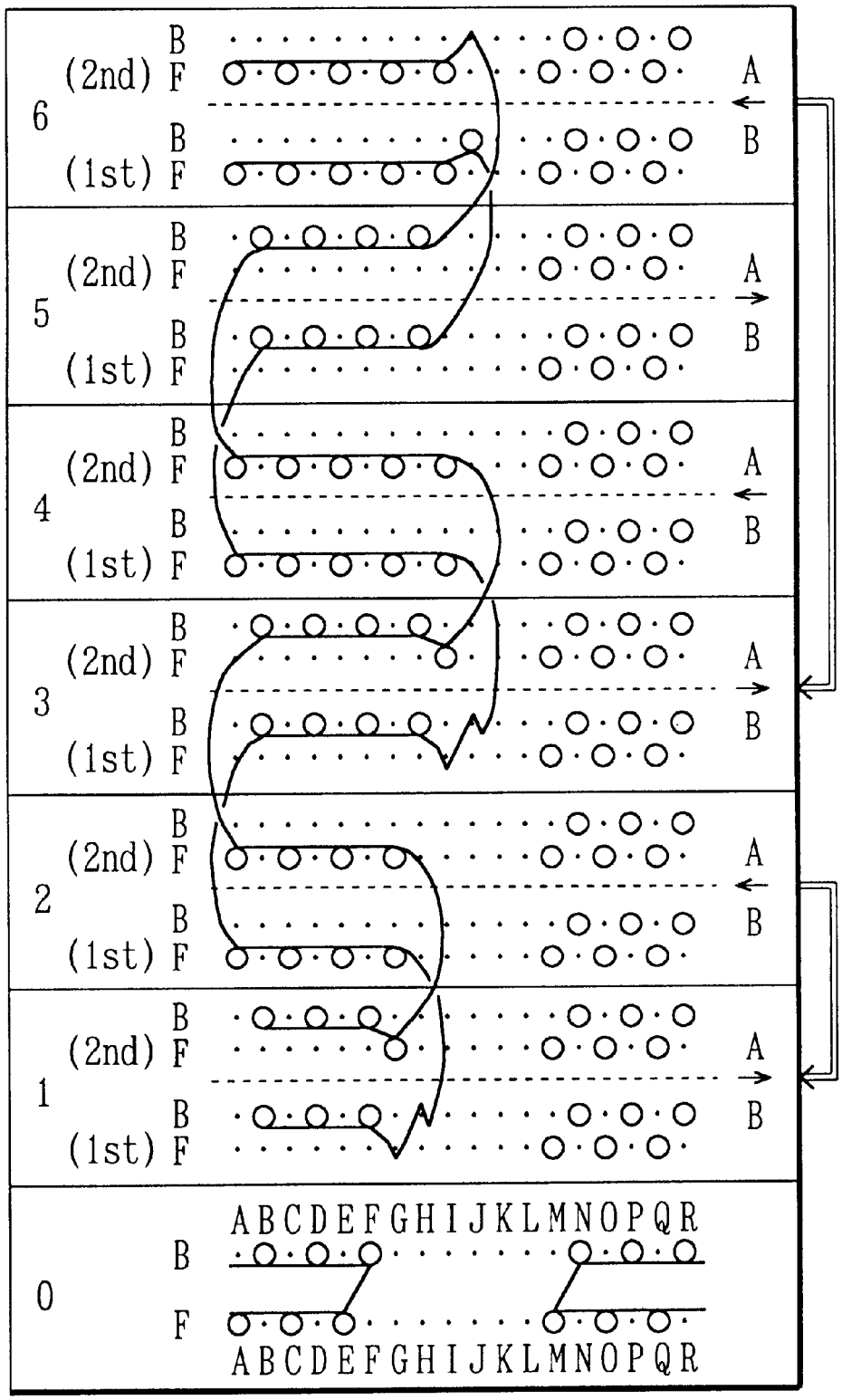
FIG. 4 shows a knitting course of the embodiment 2 of the present invention.

Next, the second embodiment will be explained with reference to FIG. 4. In the embodiment 2, the knitting of the part X, where broadening is made for knitting of every two courses, is identical to the embodiment 1. Hence explanation is started at the course 3. In the course 3, the preceding yarn feeder B is used to feed yarn to needles B•D•F•H of the back bed and the needle I of the front bed and the needle J of the back bed, and the succeeding yarn feeder A is used to feed yarn to needles B•D•F•H of the back bed and the needle I of the front bed to knit. In the course 4, the preceding yarn feeder B is used to feed yarn to needles I•G•E•C•A of the front bed, and the succeeding yarn feeder A is used to feed yarn to the same needles I•G•E•C•A of the front bed to knit. In the course 5, the preceding yarn feeder B is used to feed yarn to needles B•D•F•H of the back bed, and the succeeding yarn feeder A is used to feed yarn to the same needles B•D•F•H of the back bed to knit. In the course 6, the preceding yarn feeder B is used to feed yarn to the needle J of the back bed and needles I•G•E•C•A of the front bed to knit, and the succeeding yarn feeder A is used to tack on the needle J of the back bed, and to feed yarn to needles I•G•E•C•A of the front bed to knit. When the knitting shown in the course 3 through the course 6 is repeated in the direction of widening the knitting width, the part Y is formed, where the front fabric and the back fabric are broadened by one stitch each for every four courses formed on the front fabric FF and the back fabric BF, respectively.

Figure 5:
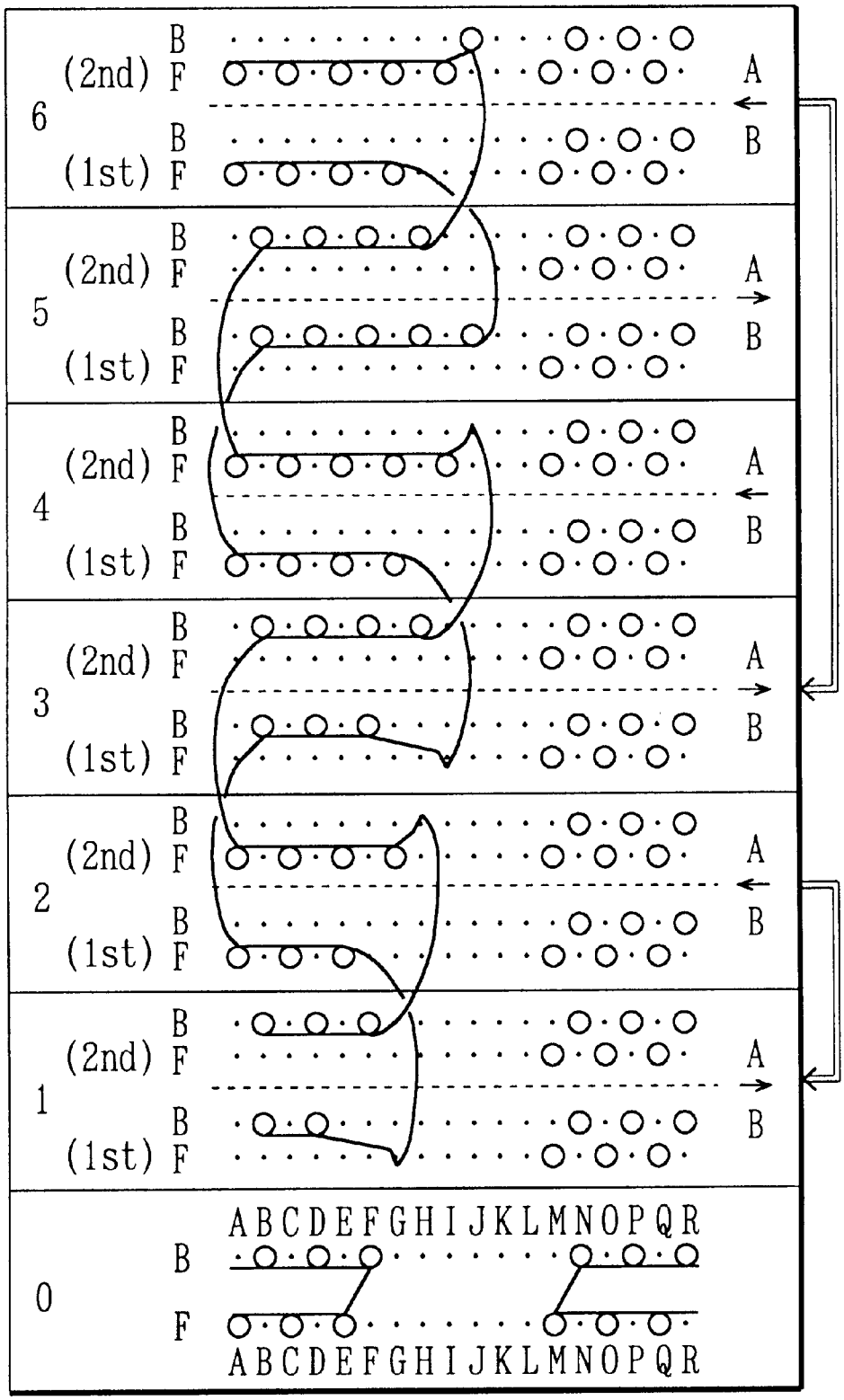
FIG. 5 shows a knitting course of the embodiment 3 of the present invention.

Next, the third embodiment will be explained with reference to FIG. 5. In the embodiment 3, in the course 1, to knit the back fabric BF towards the right edge 9 of the right sleeve 3, where broadening is made, the preceding yarn feeder B is used to feed yarn to needles B, D of the back bed, and to feed yarn to the needle G of the front bed, and the succeeding yarn feeder A is used to feed yarn to needles B•D•F of the back bed to knit. In the course 2, the preceding yarn feeder B is used to feed yarn to needles E•C•A of the front bed to knit, and the succeeding yarn feeder A is used to feed yarn to the needle H of the back bed, and to feed yarn to needles G•E•C•A of the front bed to knit. When the knitting shown in the course 1 and the course 2 is repeated in the direction of widening the knitting width, the part X is formed, where the front fabric and the back fabric are broadened by one stitch each for every two courses formed on the front fabric FF and the back fabric BF, respectively.

Next, in the course 3, the preceding yarn feeder B is used to feed yarn to needles B•D•F of the back bed to knit, and to feed yarn to the needle I of the front bed, and the succeeding yarn feeder A is used to feed yarn to needles B•D•F•H of the back bed to knit. In the course 4, the preceding yarn feeder B is used to feed yarn to needles G•E•C•A of the front bed to knit, and the succeeding yarn feeder A is used to feed yarn to the needle J of the back bed, and to feed yarn to needles I•G•E•C•A of the front bed to knit. In the course 5, the preceding yarn feeder B is used to feed yarn to needles B•D•F•H•J to knit, and the succeeding yarn feeder A is used to feed yarn to needles B•D•F•H of the back bed to knit. In the course 6, the preceding yarn feeder B is used to feed yarn to needles G•E•C•A of the front bed to knit, and the succeeding yarn feeder A is used to feed yarn to the needle J of the back bed to knit, and to feed yarn to needles I•G•E•C•A of the front bed to knit. When the knitting shown in the course 3 through the course 6 is repeated in the direction of widening the knitting width, the part Y is formed, where the front fabric and the back fabric are broadened by one stitch each for every four courses formed on the front fabric FF and the back fabric BF, respectively. In the above-mentioned embodiment, in the course 5, yarn is not fed to the needle J of the back bed, and in the course 6, yarn is fed to the needle J by the succeeding yarn feeder A. It, however, is possible to make modification such that yarn is fed to the needle J in the course 5 and yarn is not fed to the needle J in the course 6.

Figure 6:
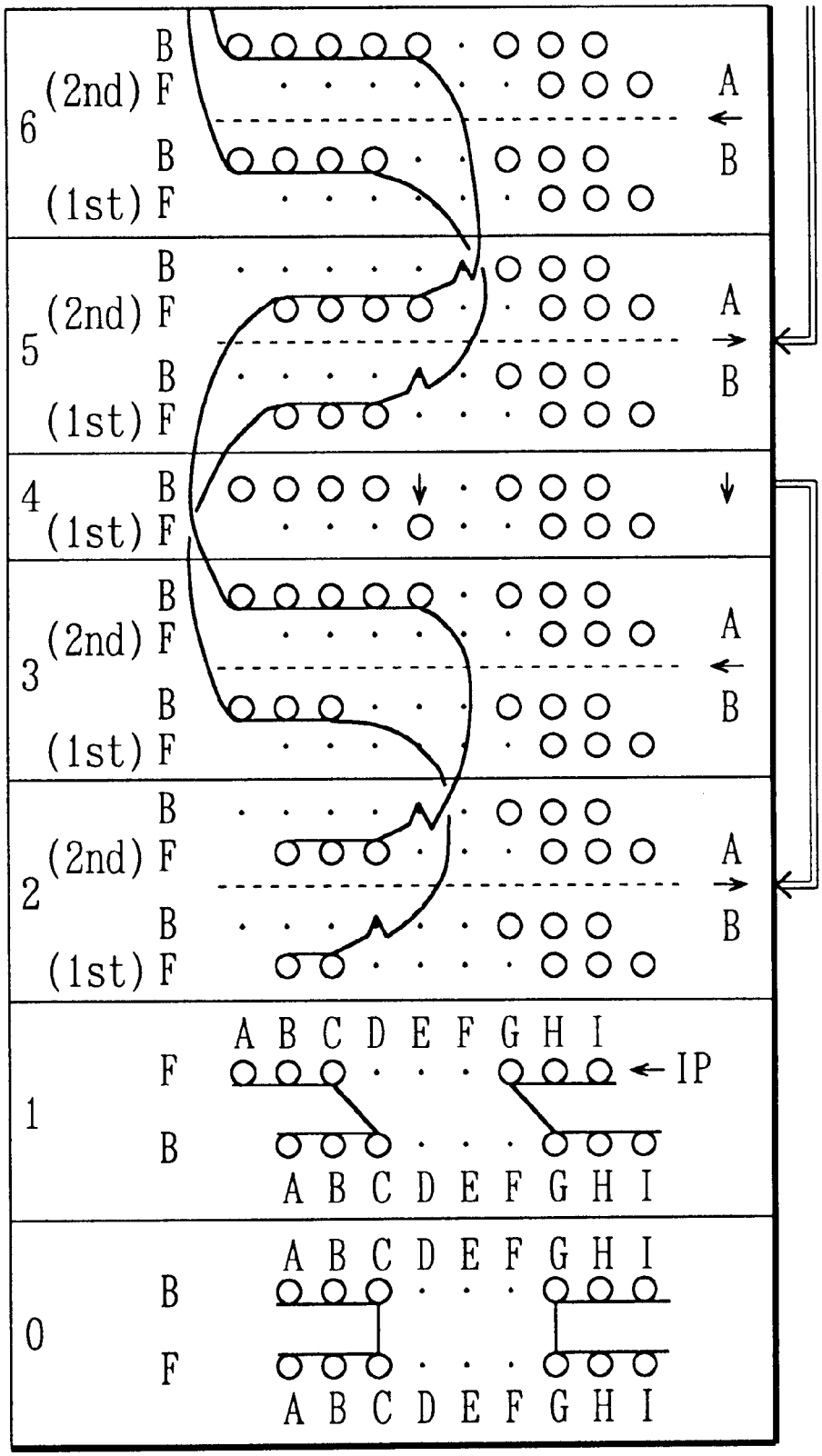
FIG. 6 shows a knitting course of the embodiment 4 of the present invention.
Figure 7:
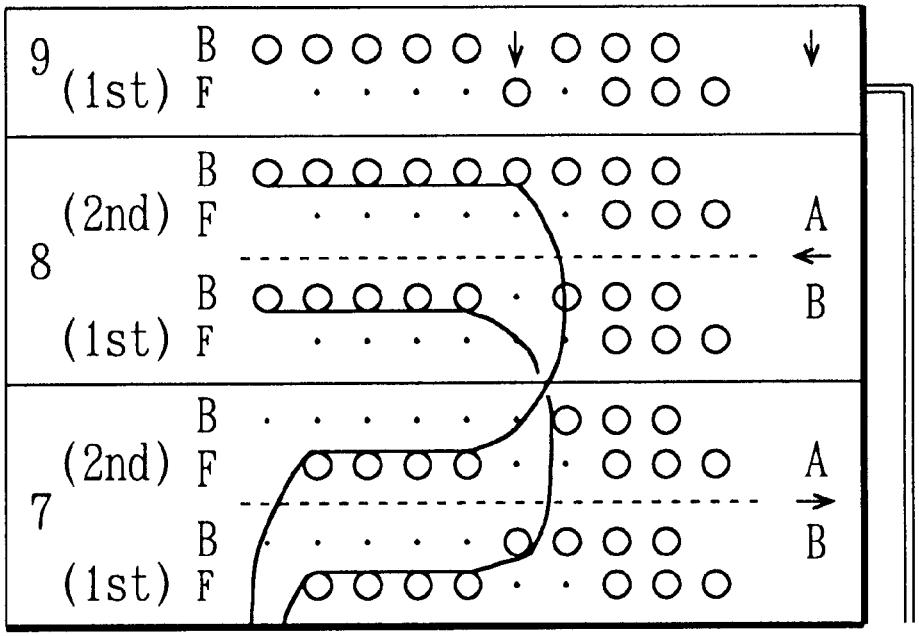
FIG. 7 shows a knitting course of the embodiment 4 of the present invention.
Figure 8:
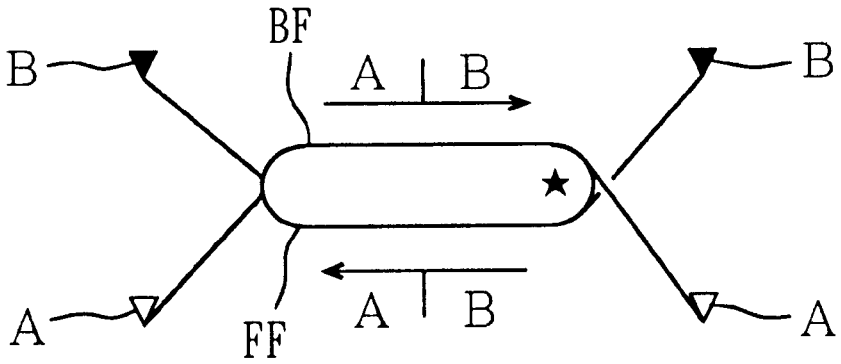
FIG. 8 is a diagram explaining the generation of crossing of yarns when tubular fabrics are knitted by double system knitting.

Next, the fourth embodiment will be explained with reference to FIG. 6 and FIG. 7. In FIG. 6 and FIG. 7, B is the yarn feeder on the front side and A is the yarn feeder on the back side. The course 0 shows the state before broadening is started. In the embodiment 4, knitting is made by fully using needles; no empty needles are arranged between needles that are used for forming loops. Loops held on needles A~C of the front bed are those of the front fabric FF of the right sleeve 2. Loops held on needles A~C of the back bed are those of the back fabric BF of the right sleeve 2. Loops held on needles G~I of the front bed are those of the front fabric FF of the body 6. Loops held on needles G~I of the back bed are those of the back fabric BF of body 6. In the course 1, the back bed is racked by one needle to the left from the condition shown in the course 0, to position the loop at the edge of the front fabric FF held on the needle C of the front bed to the right of the needle C of the back bed holding the loop at the edge of the back fabric BF. Next, in the course 2, when the front fabric FF is knitted towards the right edge 9 where broadening is made, the yarn feeder B is used as the preceding yarn feeder to feed yarn to needles A•B of the front bed, and to feed yarn to the needle D of the back bed. The succeeding yarn feeder A is used to feed yarn to to needles A•B•C of the front bed to knit, and to feed yarn to the needle E of the back bed. Next, in the course 3, the preceding yarn feeder B is used to feed yarn to needles C•B•A of the back bed, and the succeeding yarn feeder A is used to feed yarn to needles E•D•C•B•A of the back bed to knit. In the course 4, the loop held on the needle E of the back bed is transferred to the needle D of the front bed. When the knitting shown in the course 2 through the course 4 is repeated in the direction of widening the knitting width, the part X is formed, where the front fabric and the back fabric are broadened by one stitch each for every two courses formed on the front fabric FF and the back fabric BF, respectively.

Next, the knitting of the part Y will be described. In the course 5, the preceding yarn feeder B is used to feed yarn to needles A•B•C of the front bed to knit, and to feed yarn to the needle E of the back bed. The succeeding yarn feeder A is used to feed yarn to needles A•B•C•D of the front bed to knit, and to feed yarn to the needle F of the back bed. In the course 6, the preceding yarn feeder B is used to feed yarn to needles D•C•B•A of the back bed to knit, and the succeeding yarn feeder A is used to feed yarn to needles E•D•C•B•A of the back bed to knit. In the course 7 of FIG. 7, the preceding yarn feeder B is used to feed yarn to needles A•B•C•D of the front bed and the needle F of the back bed to knit, and the succeeding yarn feeder A is used to feed yarn to needles A•B•C•D of the front bed to knit. In the course 8, the preceding yarn feeder B is used to feed yarn to needles E•D•C•B•A of the back bed to knit, and the succeeding yarn feeder A is used to feed yarn to needles F•E•D•C•B•A of the same back bed to knit. In the course 9, the loop held on the needle F of the back bed is transferred to the needle E of the front bed. When the knitting shown in the course 5 through the course 9 is repeated in the direction of widening the knitting width, the part Y is formed, where the front fabric FF and the back fabric BF are broadened by one stitch each for every four courses formed on the front fabric FF and the back fabric BF, respectively.

In the above-mentioned embodiment, explanation was given by taking an example of a case where a body of a pull-over that is knitted at a constant knitting width and sleeves that are broadened at one edge are knitted together. When, for example, tights are knitted, it is possible to broaden both fabrics to produce tubular forms of desired diameters, and after that, to joint these fabrics together. In this case, broadening is made on the edge that is adjacent to the other fabric. Knitting systems in the above-mentioned embodiments are not limited to cam systems in a flat knitting machine of a type where knitting is effected by cam systems that advance and retract needles and are mounted on carriages that move sidewise over the needle beds. They include knitting waves of needles of a flat knitting machine where advancement and retraction of each needle is driven by linear motor means to knit.

It is claimed:

1. A method of knitting tubular fabrics comprising:

(a) providing a flat knitting machine having:

a first needle bed disposed on a first side of said knitting machine and a second needle bed disposed on a second side of said knitting machine, wherein said first side and said second side are disposed opposite to each other, and wherein at least one of the first needle bed and the second needle bed is sideways slidable;

at least two knitting systems;

a first yarn feeder moving on a first guide rail disposed in said first side;

a second yarn feeder moving on a second guide rail disposed in said second side;

(b) knitting a first tubular fabric on the first needle bed and the second needle bed using both the knitting systems with both the first yarn feeder and the second yarn feeder;

wherein said first tubular fabric comprises a first fabric disposed on said first side of said knitting machine and a second fabric disposed on said second side of said knitting machine, and wherein the first fabric and the second fabric are joined at edges thereof;

(c) knitting a second tubular fabric on the first needle bed and the second needle bed using both the knitting systems with both the first yarn feeder and the second yarn feeder;

wherein said second tubular fabric comprises a third fabric disposed on said first side of said knitting machine and a fourth fabric disposed on said second side of said knitting machine, and wherein the third fabric and the fourth fabric are joined at edges thereof;

(d) broadening said first tubular fabric at an edge thereof, wherein said edge is disposed towards said second tubular fabric; and thereafter (e) joining said first tubular fabric and said second tubular fabric together, wherein said broadening includes the steps of:

(i) moving the first yarn feeder in a first knitting direction towards said second tubular fabric in such a way that the first yarn feeder precedes the second yarn feeder, and simultaneously, knitting the first fabric, feeding a first needle in the second needle bed being lower than the first fabric in said first knitting direction, and further feeding a second needle in the first needle bed being further lower than said first needle in said first knitting direction, in sequence; and thereafter (ii) moving the second yarn feeder in said first knitting direction in such a way that the second yarn feeder succeeds the first yarn feeder, and simultaneously, knitting the first fabric and feeding one of said first needle and said second needle.

2. A method of knitting tubular fabrics according to claim 1, further comprising, in succession to the step (ii) the sequential steps of:

(iii) moving the second yarn feeder in a second knitting direction opposite to said first knitting direction in such a way that the second yarn feeder precedes the first yarn feeder, and simultaneously, knitting the first fabric:

(iv) moving the first yarn feeder in said second knitting direction in such a way that the first yarn feeder succeeds the second yarn feeder, and simultaneously, knitting the first fabric;

(v) moving the second yarn feeder in said first knitting direction in such a way that the second yarn feeder precedes the first yarn feeder, and simultaneously, knitting the second fabric, feeding said second needle, and further feeding a third needle in the second needle bed being lower than said second needle in said first knitting direction, in sequence;

(vi) moving the first yarn feeder in said first knitting direction in such a way that the first yarn feeder succeeds the second yarn feeder, and simultaneously, knitting the second fabric and tacking said second needle;

(vii) moving the first yarn feeder in said second knitting direction in such a way that the first yarn feeder precedes the second yarn feeder, and simultaneously, knitting the second fabric; and thereafter (viii) moving the second yarn feeder in said second knitting direction in such a way that the second yarn feeder succeeds the first yarn feeder, and simultaneously, knitting the second fabric.

3. A method of knitting tubular fabrics according to claim 1 further comprising, in succession to the step (ii), the sequential steps of:

(iii) moving the first yarn feeder in a second knitting direction opposite to said first knitting direction in such a way that the first yarn feeder precedes the second yarn feeder, and simultaneously, knitting the second fabric:

(iv) moving the second yarn feeder in said second knitting direction in such a way that the second yarn feeder succeeds the first yarn feeder, and simultaneously, knitting the second fabric;

(v) moving the first yarn feeder in said first knitting direction in such a way that the first yarn feeder precedes the second yarn feeder, and simultaneously, knitting the first fabric;

(vi) moving the second yarn feeder in said first knitting direction in such a way that the second yarn feeder succeeds the first yarn feeder, and simultaneously, knitting the first fabric;

(vii) moving the first yarn feeder in said second knitting direction in such a way that the first yarn feeder precedes the second yarn feeder, and simultaneously, feeding said second needle so as to form a knit loop and knitting the second fabric; and thereafter (viii) moving the second yarn feeder in said second knitting direction in such a way that the second yarn feeder succeeds the first yarn feeder, and simultaneously, tacking said second needle and knitting the second fabric.

4. A method of knitting tubular fabrics according to claim 1, wherein, prior to the step (i), the following steps are performed for concealing an open gap resultant from said broadening in advance:

feeding a fourth needle, holding an outermost loop of said first tubular fabric at the edge towards said second tubular fabric and being in one needle bed of the first needle bed and the second needle bed, a fifth needle, in the other needle bed of the first needle bed and the second needle bed and holding an outermost loop of said first tubular fabric in the other needle bed, and a sixth needle holding a next outermost loop in the one needle bed; and thereafter feeding needles in the other needle bed except the fifth needle.

5. A method of knitting tubular fabrics comprising:

(a) providing a flat knitting machine having:

a first needle bed disposed on a first side of said knitting machine and a second needle bed disposed on a second side of said knitting machine, wherein said first side and said second side are disposed opposite to each other, and wherein at least one of the first needle bed and the second needle bed is sideways slidable;

at least two knitting systems;

a first yarn feeder moving on a first guide rail disposed in said first side; and a second yarn feeder moving on a second guide rail disposed in said second side;

(b) knitting a first tubular fabric on the first needle bed and the second needle bed using both the knitting systems with both the first yarn feeder and the second yarn feeder;

wherein said first tubular fabric comprises a first fabric disposed on said first side of said knitting machine and a second fabric disposed on said second side of said knitting machine, and wherein the first fabric and the second fabric are joined at edges thereof;

(c) knitting a second tubular fabric on the first needle bed and the second needle bed using both the knitting systems with both the first yarn feeder and the second yarn feeder;

wherein said second tubular fabric comprises a third fabric disposed on said first side of said knitting machine and a fourth fabric disposed on said second side of said knitting machine, and wherein the third fabric and the fourth fabric are joined at edges thereof;

(d) broadening said first tubular fabric at an edge thereof, wherein said edge is disposed towards said second tubular fabric; and thereafter (e) joining said first tubular fabric and said second tubular fabric together, wherein said broadening includes the sequential steps of:

(i) moving the first yarn feeder in a first knitting direction towards said second tubular fabric in such a way that the first yarn feeder precedes the second yarn feeder, and simultaneously, knitting the first fabric except an outermost loop of the first fabric towards said second tubular fabric, wherein said outermost loop is held on a first needle in one needle bed of the first needle bed and the second needle bed, and thereafter feeding a second needle in the other needle bed of the first needle bed and the second needle bed, wherein said second needle is disposed lower than the first needle in said first knitting direction;

(ii) moving the second yarn feeder in said first knitting direction in such a way that the second yarn feeder succeeds the first yarn feeder, and simultaneously, knitting the first fabric;

(iii) moving the first yarn feeder in a second knitting direction opposite to said first knitting direction in such a way that the first yarn feeder precedes the second yarn feeder, and simultaneously, knitting the second fabric; and thereafter (iv) moving the second yarn feeder in said second knitting direction in such a way that the second yarn feeder succeeds the first yarn feeder, and simultaneously, feeding a third needle in said one needle bed, wherein said third needle is disposed above said second needle along said second knitting direction, and knitting the second fabric.

6. A method of knitting tubular fabrics according to claim 5, wherein, prior to the step (i), the following steps are performed for concealing an open gap resultant from said broadening in advance:

feeding a fourth needle, holding an outermost loop of said first tubular fabric at the edge towards said second tubular fabric and being in one needle bed of the first needle bed and the second needle bed, a fifth needle, in the other needle bed of the first needle bed and the second needle bed and holding an outermost loop of said first tubular fabric in the other needle bed, and a sixth needle holding a next outermost loop in the one needle bed; and thereafter feeding needles in the other needle bed except the fifth needle.

7. A method of knitting tubular fabrics comprising:

(a) providing a flat knitting machine having:

a first needle bed disposed on a first side of said knitting machine and a second needle bed disposed on a second side of said knitting machine, wherein said first side and said second side are disposed opposite to each other, and wherein at least one of the first needle bed and the second needle bed is sideways slidable;

at least two knitting systems;

a first yarn feeder moving on a first guide rail disposed on said first side of said knitting machine; and a second yarn feeder moving on a second guide rail disposed on said second side of said knitting machine;

(b) knitting a first tubular fabric on the first needle bed and the second needle bed using both the knitting systems with both the first yarn feeder and the second yarn feeder;

wherein said first tubular fabric comprises a first fabric disposed on said first side of said knitting machine and a second fabric disposed on said second side of said knitting machine, and wherein the first fabric and the second fabric are joined at edges thereof;

(c) knitting a second tubular fabric on the first needle bed and the second needle bed using both the knitting systems with both the first yarn feeder and the second yarn feeder;

wherein said second tubular fabric comprises a third fabric disposed on said first side of said knitting machine and a fourth fabric disposed on said second side of said knitting machine, and wherein the third fabric and the fourth fabric are joined at edges thereof;

(e) broadening said first tubular fabric at an edge thereof, wherein said edge is disposed towards said second tubular fabric; and thereafter (d) joining said first tubular fabric and said second tubular fabric together, wherein said broadening includes the sequential steps of:

(i) disposing the first fabric on the first needle bed and the second fabric on the second needle bed;

(ii) sliding one of the first needle bed and the second needle bed in such a way that a first outermost loop of the first fabric at an edge towards said second tubular fabric is closer to said second tubular fabric than a second outermost loop of the second fabric at an edge towards said second tubular fabric;

(iii) moving the first yarn feeder in a first knitting direction towards said second tubular fabric in such a way that the first yarn feeder precedes the second yarn feeder, and simultaneously, knitting the first fabric except the first outermost loop of the first fabric, and thereafter feeding a first needle in the second needle bed, wherein said first needle is closer to said second tubular fabric than said second outermost loop;

(iv) moving the second yarn feeder in said first knitting direction in such a way that the second yarn feeder succeeds the first yarn feeder, and simultaneously, knitting the first fabric and then feeding a second needle in the second needle bed, wherein said second needle is closer to said second tubular fabric than said first needle;

(v) moving the first yarn feeder in a second knitting direction opposite to said first knitting direction in such a way that the first yarn feeder precedes the second yarn feeder, and simultaneously, knitting the second fabric except said second needle;

(vi) moving the second yarn feeder in said second knitting direction in such a way that the second yarn feeder succeeds the first yarn feeder, and simultaneously, feeding said first needle and said second needle so as to form a loop on said first needle and said second needle respectively and knitting the second fabric; and thereafter (vii) transferring the loop on said second needle to a third needle on the first needle bed.

8. A method of knitting a tubular fabric comprising:

providing a flat knitting machine having:

a first needle bed disposed on a first side of said knitting machine and a second needle bed disposed on a second side of said knitting machine, wherein said first side and said second side are disposed opposite to each other, and wherein at least one of the first needle bed and the second needle bed is sideways slidable;

at least two knitting systems;

a first yarn feeder for feeding a first yarn and moving on a first guide rail disposed on said first side; and a second yarn feeder for feeding a second yarn and moving on a second guide rail disposed on said second side; and knitting a first tubular fabric on the first needle bed and the second needle bed using both the knitting systems with both the first yarn feeder and the second yarn feeder;

wherein said first tubular fabric comprises a first fabric disposed on said first side of said knitting machine and a second fabric disposed on said second side of said knitting machine, wherein the first fabric and the second fabric are joined at edges thereof; and knitting at an edge where the first yarn and the second yarn cross with each other, a first needle in the first needle bed and a second needle in the second needle bed holding a respective loop at the edge, and feeding only one of the first yarn and the second yarn to one of the first needle and the second needle.

* * * * *